US005830552A

United States Patent [19]

Meier et al.

[11] Patent Number: 5,830,552

[45] **Date of Patent: *Nov. 3, 1998**

[54] TABLE OR COVER PLATE

[75] Inventors: Max Meier; Karl-Heinz Meier, both of Lichtenau, Germany

[73] Assignee: Mecalit GmbH Kunststoffverarbeitung, Lichtenau, Germany

[ * ] Notice: The term of this patent shall not extend beyond the expiration date of Pat. No. 5,436,048.

[21] Appl. No.: 432,070

[22] Filed: May 1, 1995

Related U.S. Application Data

[63] Continuation of Ser. No. 17,676, Feb. 12, 1993, Pat. No. 5,436,048.

[30] Foreign Application Priority Data

Feb. 13, 1992 [DE] Germany ..... 42 04 161.9

[51] Int. Cl.[6] ..... A47B 96/18

[52] U.S. Cl. ..... 428/68; 52/782.2; 52/782.24; 52/800.1; 52/800.11; 108/27; 312/137; 428/119; 428/121; 428/192; 428/194

[58] Field of Search ..... 428/119, 121, 428/192, 194, 99, 68; 52/783, 784, 823, 824, 825, 826, 822, 821; 108/27; 312/137

[56] References Cited

U.S. PATENT DOCUMENTS 5,436,048 7/1995 Meier ..... 428/68

FOREIGN PATENT DOCUMENTS 2833863 2/1980 Germany .
2242125 9/1991 United Kingdom .

*Primary Examiner*—Nasser Ahmad
*Attorney, Agent, or Firm*—Antonelli, Terry, Stout & Kraus, LLP

[57] ABSTRACT

A table or cover plate comprises a core plate, e.g. of a wooden material, with an optionally coated top surface and an all-round edge protection formed by a plastics section, which covers the cut faces of the core plate and engages over its top and underside. The edge protection comprises two angle sections injection moulded as a closed profile, whereof an outer frame covers with a long leg the cut faces and projects over the underside of the core plate and with its other leg engages over the top coating, whereas the other, inner frame with its one leg engages on the inside of the long leg of the outer frame on its area projecting over the underside and with its other leg engages on the underside of the core plate and that the frames are interconnected at their engaging legs.

32 Claims, 4 Drawing Sheets

TABLE OR COVER PLATE

This is a continuation of application Ser. No. 017,676, filed Feb. 12, 1993, now U.S. Pat. No. 5,436,048.

FIELD OF THE INVENTION

The invention relates to a table or cover plate or board with the features including a core plate with a top, an underside and lateral cut faces with at least one all-round edge protection formed from a plastic section which covers the cut faces of the core faces and engages over the top and underside of the core plate.

BACKGROUND OF THE INVENTION

In the case of plates of the aforementioned type the edge protection fulfills several functions. It is firstly intended to protect the edges against mechanical damage, while also protecting the user against injury. If the core plate is made from a wooden material, the open-pore cut edges of the core plate must be protected against dirtying and moisture access. Finally, the edge protection is intended to make it easier to grip the plate, while also facilitating the handling and transportation of a piece of furniture or kitchen appliance provided with the plate, e.g. a table, refrigerator, washing machine, spin or tumble dryer, etc. The extending of the edge protection beyond the underside of the plate, so that it is possible to engage below the latter also helps to fulfill the latter function. In the case of kitchen appliances, in which the cover plate mainly serves as a placing and working surface, the aim of the downwardly drawn edge protection is to cover the gap between the plate and the appliance casing. In addition, in this case on the underside of the plate, are frequently provided functional parts, such as sleeves, clips, etc., made from plastic and by which the plate is fixed to the appliance casing. These functional parts are also concealed by the edge protection.

The edge protection comprises a mechanically adequately stable plastic, which is also resistant to more or less aggressive media and also to the weather. This plastic is placed in an injection mould, in which the prefabricated core plate with a cover layer on one or both sides is injection moulded onto the open-pore cut edges of the core plate, so that the plastic penetrates the pores and the edge protection is engaged with the core plate. The edge protection also engages at least over the top of the core plate, which leads to a firm, tight connection between the edge protection and the core plate. It is also known to produce the edge protection in a separate operation, e.g. by the injection moulding or extruding of a ledge-like profile or section and connecting it in a further operation by bonding to the core plate.

The known injection moulding of the edge protection onto the core plate has the advantage that the sought functions can be fulfilled in an inexpensive manner. However, it is disadvantageous that it is not subsequently possible to detach the edge protection. This problem also exists from environmental standpoints if the table or cover plate, optionally also the furniture protected by it is damaged or made valueless or unusable in some other way and must be sent for refuse disposal purposes or it is necessary for the manufacturer to take it back (such a responsibility already existing e.g. in the case of refrigerators), the manufacturer then having to dispose of and optionally reuse the same. It is then necessary to separate the materials, so that it is desirable in the case of cover or table plates to be able to separate entirely or at least to a major extent from the core plate the edge protection with its relatively high plastic proportion, which is also reusable.

SUMMARY OF THE INVENTION

The aim underlying the invention is to provide a cover or table plate, which in the case of inexpensive manufacture and functionally correct construction, allows a simple separation of the edge protection and the core plate.

According to the invention, the edge protection comprises two angle sections injection moulded as a closed frame, whereof an outer frame with a long leg covers the cut faces of the core plate and projects over the underside thereof and with its other leg, engages over the top side, while the other, inner frame with its one leg engages on the inside of the long leg of the outer frame in its area projecting over the underside and, with its other leg, engages on the underside of the core plate and, after inserting the core plate in the outer frame, both frames are interconnected at their engaging legs.

The two closed frames formed from angle sections or profiles can, in a known manner, be produced by injection moulding and, consequently, have an adequate dimensional stability. The prefabricated core plate can be so placed from above in the outer frame, so that its top rests on the inside of one leg of the angle section, while the other, longer leg projecting upwards in the assembly position covers the cut edges of the core plate. In the case of a roughly parallel arrangement with the outer frame, the inner frame is then placed from above on the underside of the core plate, so that its outer leg internally engages on the long leg of the outer frame and its other leg rests on the underside of the core plate. As a result of the connection of the engaging legs a closed, frame-like structure is obtained, which completely surrounds the core plate, covers its optionally open-pore cut faces and engages over the top and bottom of the core plate edges, so that the cut faces are effectively protected against access of dirt and moisture. This leads to a functionally correct construction in the same way of an injection moulded on edge protection. The manufacturing procedure is not or is only significantly more complicated. On the other hand, it is readily possible to remove the edge protection with limited force expenditure from the core plate and to obtain the two components in type-pure manner, because there is no self-substance or, in the case of moulded on edge protection, intimate connection of the edge protection and the core plate.

In accordance with further features of the invention the edge protection comprises two angle sections injection moulded as a closed frame, whereof the outer frame with a shorter leg engages over the top of the core plate and with its longer leg projects downwards over the core plate and that the inner frame with a substantially vertical leg covers the cut face of the core plate, while with its other, substantially horizontal leg it engages below the core plate and that, after inserting the core plate with the inner frame, in the outer frame both frames are interconnected in a vicinity of the long leg of the outer frame and the vertical leg of the inner frame.

In this construction firstly the core plate is inserted in the inner frame and then, together with the latter, in the outer frame and finally the two legs in complete or only zonal engagement with one another are joined by welding or bonding. Here again, in the vicinity of the cut face and at the transition between the latter and the top and bottom surface, the plate is completely protected by the edge protection. At the time of disposal, the edge protection can be detached from the core plate with little force being required.

According to the invention, the leg of the outer frame projecting over the underside with the leg of the inner frame engaging thereon are injection moulded in one piece and connected by a hinged joint arranged in the vicinity of the subsequent lower edge of the edge protection and that the other leg of the inner frame is screwed to the underside of the core plate.

In the aforementioned construction the two frames are injection moulded together in one piece as angle sections, the injection moulding forming a type of Z-profile. The long leg of the subsequent outer frame is connected by a hinged joint, e.g. a film hinge, with the subsequent outer leg of the inner frame, which is only interrupted in the vicinity of the corners of the frame-like section. In the extended position of these legs of the two angle sections the core plate is inserted from above, so that its top rests internally on the other leg of the outer frame. The inner frame is then folded inwards, so that its outer leg internally engages on the long leg of the outer frame and the inner leg engages on the underside of the core plate. By several spaced screws, the inner leg is fixed to the underside of the core plate and as a result a stable frame enclosing the core plate is formed.

Preferably, the construction is such that the leg of the inner frame engaging on the underside of the core plate, accompanied by the fixing of the substantially parallel leg of the outer frame on the top, is threadably inserted into the underside of the core plate.

Pretension can easily be obtained in that the long leg of the outer frame is less long in the area projecting over the underside of the core plate than the leg of the inner frame engaging on it, so that on screwing down the other leg, tensile and bending forces act on the long leg, which draw the leg of the outer angle section engaging on the top onto the latter. This leads to a moistureproof seal between the core plate and the legs engaging over the top and bottom surfaces.

Another embodiment of the present invention is characterized in that the engaging legs of the two frames are interconnected by bonding or welding. The bonding or welding of the engaging legs can be used both in a separate manufacture of the two frame-like parts and when the frames are injection moulded in one piece as a Z-profile and brought into the end position by folding in the subsequently inner frame. In the latter case the previously described screw connection is rendered superfluous.

Independently of whether the frames are interconnected and/or the inner frame is additionally screwed to the core plate, according to a further improved embodiment, between the inside of the outer frame and at least the transition area of the cut face and the top of the core plate, an elastomer seal is provided.

Since, when using the cover plates, it is frequently likely that there is liquid on the top surface and which could soak into the edge protection, this construction leads to an absolutely dampproof construction.

It is also possible to provide an elastomer seal in the transition area between the underside and the cut face, so as to cover the entire cut face and consequently engages over the top and bottom surfaces of the core plate.

When using an elastomer seal preferably it is injection moulded in two-component injection moulding into a depression on the inside of the outer angle section. To the extent that the seal covers the underside of the core plate, it can also be injected in a two-component injection moulding process into a depression on the outside of the inner frame.

In both of the aforementioned embodiments the frame-like angle sections are injection moulded in a single injection mould, the core plate, as described hereinbefore, always being placed from above in the outer frame and the connection between the outer and inner frames taking place in unchanged manner as described hereinbefore.

In addition, cover plates, particularly for refrigerators, are known, in which the edge protection is previously injection moulded as a frame-like angle section, the core plate is placed in the said section and subsequently the gap between the two is filled with polyurethane, so as to seal the cut faces and obtain a compact edge protection. In addition, plastic sections injection moulded onto the underside are fitted and serve to fix the plate to the refrigerator casing. This construction also fails to permit the separation between the edge protection and the core plate and as a result of the different materials of the edge protection type purity is not obtained. In such a construction the invention proposes the injection moulding onto the cut faces of the core plate of a thin ledge or strip of the same plastic, which at least engages over the underside of the core plate and that the frame is connected to the said strip.

In accordance with the invention the injection moulded on, thin strip seals the cut faces of the core plate.

The entire edge protection consists of a single material. The frame formed from an angle section, which has the stability necessary for an effective edge protection, can be separated from the strip with a relatively limited force expenditure, so that only a relatively small amount of plastic is left on the core plate. The connection between the core plate and the injection moulded on strip and the frame-like angle section can be in self-substance form, e.g. by successive injection moulding of the plastic parts, by welding, bonding or mechanically and optionally only in punctiform manner.

It is e.g. possible that after inserting the core plate in the frame and which has a size greater than the core plate, the strip is produced by partial filling of the gap between the frame and the cut faces. In place of this between the strip and the longer leg of the frame is provided a gap, which is bridged by individual ribs. The ribs, which must mainly absorb compressive forces between the outer frame and the injection moulded on strip, can be made very thin and optionally can be fitted by weak predetermined breaking points to the injection moulded on strip or to the frame, so that the frame, optionally together with the ribs, can be separated without any problem.

Another embodiment of the invention is characterized in that the strip additionally engages over the top surface and the core plate with the injection moulded on strip locks on the outer frame.

In the aforementioned embodiment it can exclusively be a mechanical locking connection. However, optionally and following the locking in, there can be a bonding or welding in the vicinity of the locking connection, which may optionally only be in punctiform manner.

The plate constructed according to the invention is intended mainly as a cover plate for kitchen appliances. Thus, the leg of the inner frame or the injection moulded on strip engaging over the underside has the necessary sections or profiles for fixing the plate to the kitchen appliance casing.

According to another embodiment of the invention below the core plate is provided an insulating plate made from another material with thermal and/or acoustic insulating properties, which is directly or indirectly connected to the core plate. This leads to a plate union, in which the top core plate has the function of a covering or working plate, i.e. it is e.g. constituted by a cut and scratch-proof material or has a coating with such properties, whereas the bottom insulating plate provides a thermal or acoustic insulation. If such a plate union is used for a refrigerator, the insulating plate can e.g. replace the upper insulation normally fitted within the refrigerator casing. The core plate can be made from a wooden material and can be provided on its top surface with a cut and scratch-proof and optionally also decorative top or cover coating, whereas, the insulating plate can be made from a foamed plastic.

A development of this embodiment is characterized in that the insulating plate has the same contour as the core plate and its cut faces are covered by the inner frame or the strip and that the inner frame or the strip engages over the underside of the insulating plate and the longer leg of the outer frame projects over the underside of the insulating plate. In this case the plate union is held together by the outer frame on the one hand and the inner frame or the strip on the other. At the time of reutilization it is easily possible to separate the parts or the materials forming them in type-pure manner.

According to another development the insulating plate is cut back at its cut faces with respect to the core plate and the inner frame or the strip engages with its one leg over the underside of the core plate, while the longer leg of the outer frame projects downwards over the insulating plates. In this case the insulating plate is directly connected to the core plate, e.g. by bonding, but its outside is covered by the edge protection.

BRIEF DESCRIPTION OF THE DRAWINGS

Further details and advantages of the present invention can be gathered from the following description of preferred embodiments and the attached drawings, wherein.

DETAILED DESCRIPTION

Figure 1:
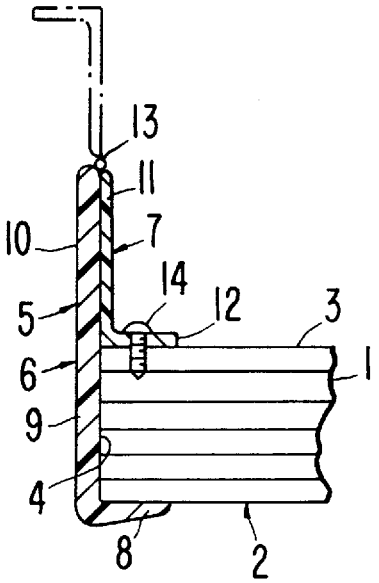
FIGS. 1–6 are partial cross-sectional views in a vicinity of one side of the plate in a production position constructed in accordance with the present invention.

In all the embodiments the cover or table plate has a core plate 1 made from a wooden material, which at least on its top surface 2 and optionally also on its underside 3 is provided with a moistureproof top or cover coating, whereas the cut faces 4 are open and generally have a porous surface. The core plate can also be made from glass, plastic or metal, e.g. aluminium. The plate also has an edge protection 5, which covers the cut faces 4 and simultaneously engages over the core plate 1 on the top 2 and the underside 3. If the plate is made from a wooden material, in addition to the protective function it is also possible to prevent the access of moisture to the cut face.

In the embodiment according to FIG. 1 the edge protection comprises two angle sections, namely an outer angle section 6 and an inner angle section 7. The angle sections 6,7 form a closed frame, which is produced in one piece by injection moulding. The outer frame 6 has a shorter leg 8 engaging over the top 2 or the top coating of the cover plate 1 provided there and a longer leg 9 covering the cut face 4 of the core plate 1 and which with a portion 10 engages over the underside 3 of the core plate 1. The inner frame 10 comprises a leg 11, which engages on the projecting portion 10 of the leg 6 on the outer frame 5 and a leg 12, which engages on the underside 3 of the core plate 1.

In the embodiment according to FIG. 1, the two frames 6,7 are interconnected by a film hinge 13 and are produced together in a single injection moulding process in the form of a Z-profile, the inner frame 7 being in the dot-dash line position. In this position the core plate 1 is inserted in the outer frame 6 or engaged on the shorter leg 8 of the outer frame 6 and then the inner frame 7 is folded inwards about the film hinge 13 and fixed by screws 14 to the core plate 1, the inner frame being interrupted at the corners. By a corresponding length tolerance between the projecting portion 10 of the longer leg 9 on the outer frame 6 and the leg 7 on the inner frame, on applying the screws 14 to the outer frame 6 a pretension can be introduced, which draws the shorter leg 8 of the outer frame 6 onto the top 2 of the core plate 1.

Figure 2:
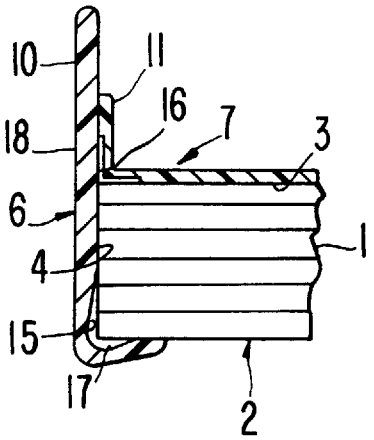

In the embodiment according to FIG. 2 the frames 6 and 7 are injection moulded in separate moulds. Once again the core plate 1 is inserted in the outer frame 6 and then the inner frame 7 is engaged. The legs 10 and 11 of both frames 6 and 7 engage zonally on one another and can either be welded together, e.g. by ultrasonics, high frequency, etc., or can be bonded together.

To obtain a reliable sealing of the cut faces 4 of the core plate 1, the outer frame 6 is provided in the vicinity of its inner corner with a depression 15 and the inner frame 7 has in the vicinity of its outer corner a depression 16, into which is injected by two-component injection moulding an elastomer seal 17 or 18, so that at the transition between the top 2 or underside 3 and the cut face 4 an elastic seal is provided.

Figure 3:
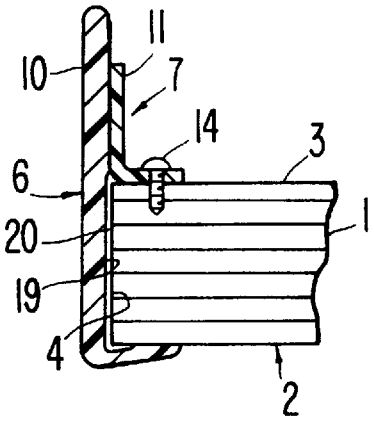
Figure 4:
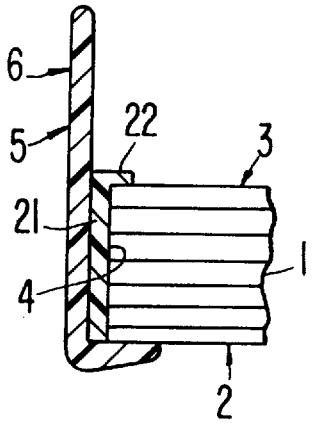
Figure 5:
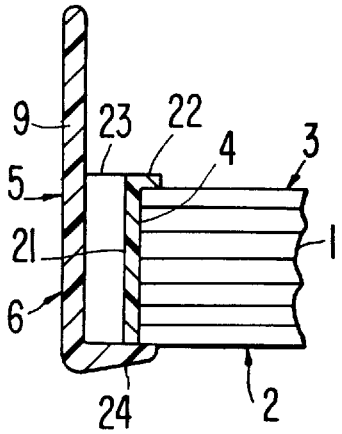

In the embodiment according to FIG. 3 the outer frame 6 is provided on its inside with a depression 19, which extends over the entire area covering the cut face 4 and also somewhat beyond it. In the depression is once again injection moulded an elastomer seal 20 which, after inserting the core plate 1, seals the cut faces and the transition area to the top 2 or bottom surface 3 of the core plate 1. The inner frame 7 is once again fixed by screws 14 to the core plate 1 and in the vicinity of the longer leg 11 is connected in self-substance manner to the projecting portion 10 of the outer frame 6. In the embodiment according to FIGS. 4 to 6 the cut face 4 of the core plate 1 is covered by a thin injection moulded on strip or ledge 21, whose one leg 22 engages at least over the underside of the core plate 1. As in the embodiments according to FIGS. 1 to 3, the edge protection 5 also has an angle section frame 6 produced by injection moulding. In the embodiment of FIG. 4 the core plate 1 is inserted in the frame 6 and between it and the frame 6 there is a narrow gap, which is filled with the same plastics material, accompanied by the formation of the strip 21 with its leg 22.

In the embodiment shown in FIG. 5 once again the outer frame 6 of the edge protection 5 is injection moulded beforehand. The frame 6 is then placed in an injection mould in the same way as the core plate 1. The strip 21 with its leg 22 engaging over the underside 3 of the core plate 1 is then injection moulded on. The spacing between the cut faces 4 and the outer frame 6 is larger in this embodiment than in that according to FIG. 4. This larger gap is bridged by ribs 23 injection moulded together with the strip, so that the leg 9 of the outer frame 6 is supported against lateral compressive forces. The connection between the outer frame 6 and the strip 21 takes place, during injection moulding, by the point 24 and the ribs 23.

Figure 6:
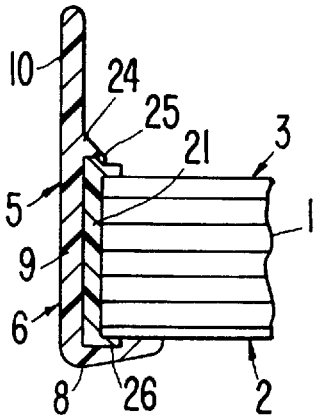

In the embodiment according to FIG. 6 the outer frame 6 is provided in the vicinity of the projecting portion 10 of the longer leg 9 with an inwardly projecting nose 24, which can also have an all-round construction, if desired. The strip 21 is either subsequently injection moulded into the gap between the core plate 1 and the outer frame 6 or is previously injection moulded onto the cut faces of the core plate 1 and is then locked by inserting the core plate 1 with the strip 21 in the outer frame 6. Optionally, in the area 25 welding or bonding can additionally take place. In addition, the strip 21 in the embodiment according to FIG. 6, engages with a leg 26 over the top 2 of the core plate 1 and the leg 26 is located in a corresponding depression of the leg 8 of the outer frame 6.

Figure 7:
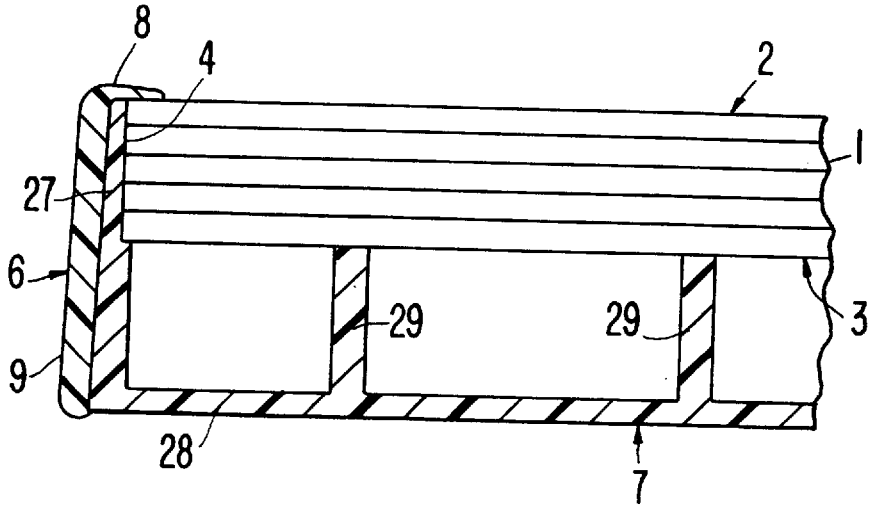
FIGS. 7–11 are partial cross-sectional views of the cover or table plate of the present invention in a use position.

In the embodiment according to FIG. 7, as is shown by the plates in the use position, the outer frame 6 and the inner frame 7 are once again constructed as angle sections. The short leg of the frame 6 engages over the top 2 of the core plate 1 and with its long leg 9 projects downwards over the inner frame 7. The inner frame 7, which passes all round in the marginal area of the core plate 1, covers with its one leg 27 the cut face 4 of the core plate, while the other leg 28 engages by webs 29 on the underside 3 of the core plate 1. The resulting lattice-like structure can be used for the construction of fixing means, by means of which the plate is fixed to a kitchen furniture item, e.g. a refrigerator or dishwasher casing. The two frames 6,7, which can once again be produced separately by injection moulding, are interconnected by welding at their legs 9 and 27.

Figure 8:
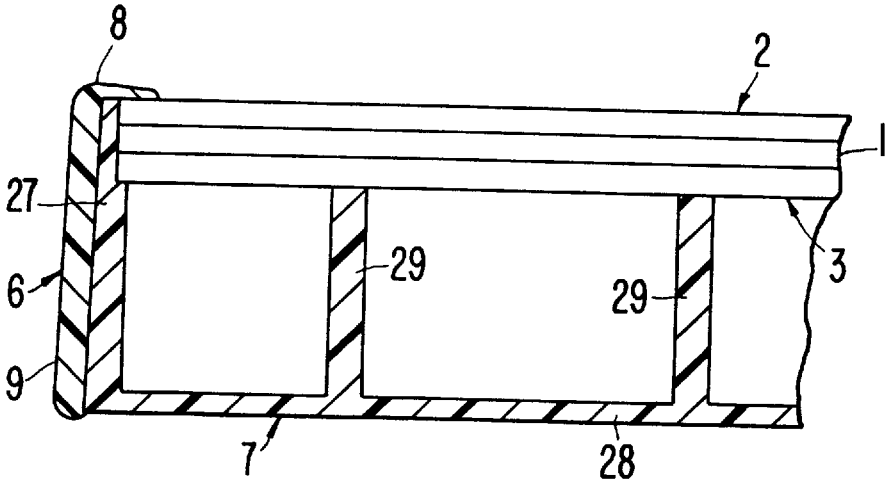

As is apparent from a comparison of FIGS. 7, and 8, the inner frame 7 can be constructed in such a way that core plates 1 of different thickness can be used with the same overall height, merely in that the height of the webs 29 is correspondingly adapted.

In the embodiment according to FIG. 8 the edge protection once again comprises an outer frame 6 and an inner frame 7. The outer frame 6 has a corresponding construction and function to the frame 6 of FIGS. 7 and 8, while the inner frame 7 is constructed as a type of T-profile, which with its web 30 covers the cut face 4 of the core plate 1 and an insulating plate 31 positioned below it. With one leg 32 of the chord of the T-profile, the frame 7 engages over the underside of the insulating plate 31, whilst the outwardly projecting, other leg 33 is shorter. Against the leg 33 engages the longer leg 9 of the outer frame at position 34, where the two frames are welded, bonded or otherwise joined together. Optionally also the shorter leg 8 of the outer frame 6 and the web 30 can be additionally welded or bonded at 35. At the time of disposal, frames 6 and 7 can easily be separated from the core plate and the insulating plate, while the plates can also be separated from one another.

Figure 9:
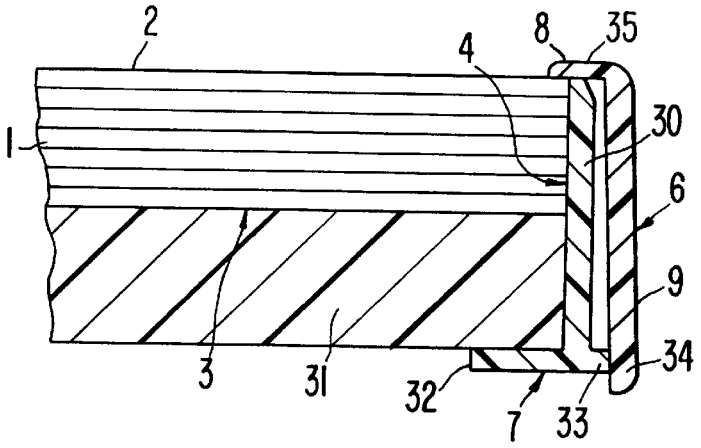
Figure 10:
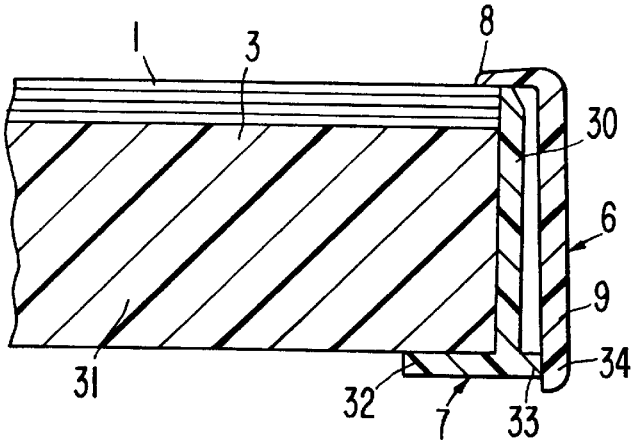

In the embodiment according to FIG. 10 the core plate 1 is thinner and the insulating plate 31 thicker than in FIG. 9. As in FIG. 9, the insulating plate can serve as a steam barrier, e.g. in a washing or rinsing machine, or as an insulating plate in a piece of kitchen furniture, or may only have a stabilizing function.

Figure 11:
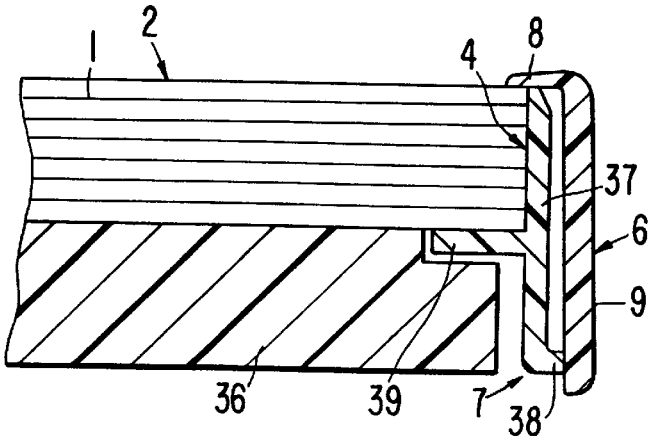

Whereas, in the embodiments according to FIGS. 9 and 10, the outer frame 6 and the inner frame 7 combine the plates 1,31 into a composite body, in the embodiment according to FIG. 11, an insulating plate 36 is directly connected to the underside of the core plate 1. Here again the short leg 8 of the outer frame 6 projects over the top 2 of the core plate 1. The inner frame 7 has a long leg 37, with which it covers the cut faces 4 of the core plate 1 and which extends up to the underside of the insulating plate 36 and is bent outwards at its lower end to form a rib 38, to which the long leg 9 on the outer frame 6 is fixed by welding, bonding, etc. In the central region, the inner frame 7 has an inwardly projecting strip 39 engaging below the core plate 1. The necessary free space for assembly and at the same time providing an adequate insulating action is obtained in that the insulating plate 36 is cut back inwards.

We claim:

1. A plate comprising:

a core plate with a top, an underside and lateral cut faces, a frame supporting the core plate and including closed inner and closed outer angle sections, the inner closed angle section directly contacting an outside periphery of the lateral cut faces but being free of being bonded to the lateral cut faces and extending from the top to the underside and having at least a first ledge projecting radially inward from the outside periphery and engaging at least the underside in an area displaced radially inward from the outside periphery, and the outer closed angle section having a radially inwardly extending projection directly engaging the top and a surface engaging an outside surface of the inner closed angle section and projecting from above the top to below the underside; and wherein the inner and outer closed angle sections are injection molded and are separable from the core by separating the direct contact but being free of being bonded of the inner closed angle section to the lateral cut faces of the outside periphery.

2. A plate in accordance with claim 1, wherein the inner closed angle section further comprises:

a projection projecting radially inward from the outside periphery and also engaging the top in an area disposed radially inward from the outside periphery.

3. A plate in accordance with claim 1 further comprising:

ribs which extend between a radially outward facing surface of the inner closed angle section and a radially inward facing surface of the outer closed angle section frame.

4. A plate in accordance with claim 3 wherein:

the ribs are part of the inner closed angle section.

5. A plate comprising:

a core plate with a top, an underside and lateral faces and a frame supporting the core plate and including a closed circumferential protection of the lateral faces which engages over the top and underside of the core plate, the circumferential protection comprising first and second closed injection molded angle sections, the first angle section directly contacting the lateral faces but being free of being bonded to the lateral faces from the underside to the top and extending below the underside and the second angle section having a surface facing the lateral faces and engaging a surface of the first angle section which faces radially outward away from the cut lateral faces from below the underside up to the top and a section projecting radially inward from outside a periphery of the lateral faces into direct surface engagement with the top surface at a radius radially inward from the periphery; and wherein the first and second closed angle sections are separable from the core by separating the direct contact but being free of being bonded of the first angle section to the lateral faces.

6. A plate in accordance with claim 5 wherein:

the first angle section has a ledge which is parallel to the underside in surface engagement with the underside and projects radially inward from the periphery of the lateral faces.

7. A plate in accordance with claim 5 wherein the first angle section further comprises:

a section disposed below the underside and extending radially inward from a radius outside the periphery to a radius inside a radius of the peripheral; and at least one web projecting upward from a surface of the section into surface contact with the underside.

8. A plate in accordance with claim 6 wherein the first angle section further comprises:

a section disposed below the underside and extending radially inward from a radius outside the periphery to a radius inside a radius of the peripheral; and at least one web projecting upward from a surface of the section into surface contact with the underside.

9. A plate in accordance with claim 6 wherein:

the ledge comprises a radially inwardly projecting section which extends orthogonally from a surface of the first angle section from a location below the underside and which is parallel to the cut faces and which extends from the top to below the underside.

10. A plate in accordance with claim 9 wherein the surface of the first angle section has a radius equal to a radius of a periphery of the lateral faces.

11. A plate in accordance with claim 5 wherein:

the first angle section has a projection which projects radially outward and engages an inner surface of the second angle section below the underside to define a void between the radially inward projection of the second angle section and the projection of the first angle section.

12. A plate in accordance with claim 9 wherein:

the first angle section has a projection which projects radially outward and engages an inner surface of the second angle section below the underside to define a void between the radially inward projection of the second angle section and the projection of the first angle section.

13. A plate in accordance with claim 10 wherein:

the first angle section has a projection which projects radially outward and engages an inner surface of the second angle section below the underside to define a void between the radially inward projection of the second angle section and the projection of the first angle section.

14. A plate in accordance with claim 9 further comprising:

an insulating plate engaging the underside.

15. A plate in accordance with claim 10 further comprising:

an insulating plate engaging the underside.

16. A plate in accordance with claim 11 further comprising:

an insulating plate engaging the underside.

17. A plate in accordance with claim 12 further comprising:

an insulating plate engaging the underside.

18. A plate in accordance with claim 13 further comprising:

an insulating plate engaging the underside.

19. A plate in accordance with claim 1 further comprising:

a joint joining the inner and outer closed angle sections together with the joint being either a weld or a bond.

20. A plate in accordance with claim 2 further comprising:

a joint joining the inner and outer closed angle sections together with the joint being either a weld or a bond.

21. A plate in accordance with claim 3 further comprising:

a joint joining the inner and outer closed angle sections together with the joint being either a weld or a bond.

22. A plate in accordance with claim 4 further comprising:

a joint joining the inner and outer closed angle sections together with the joint being either a weld or a bond.

23. A plate in accordance with claim 5 further comprising:

a joint joining together the first and second closed angle sections together with the joint being either a weld or a bond.

24. A plate in accordance with claim 6 further comprising:

a joint joining together the first and second closed angle sections together with the joint being either a weld or a bond.

25. A plate in accordance with claim 7 further comprising:

a joint joining together the first and second closed angle sections together with the joint being either a weld or a bond.

26. A plate in accordance with claim 8 further comprising:

a joint joining together the first and second closed angle sections together with the joint being either a weld or a bond.

27. A plate in accordance with claim 9 further comprising:

a joint joining together the first and second closed angle sections together with the joint being either a weld or a bond.

28. A plate in accordance with claim 10 further comprising:

a joint joining together the first and second closed angle sections together with the joint being either a weld or a bond.

29. A plate in accordance with claim 11 further comprising:

a joint joining together the first and second closed angle sections together with the joint being either a weld or a bond.

30. A plate in accordance with claim 12 further comprising:

a joint joining together the first and second closed angle sections together with the joint being either a weld or a bond.

31. A plate in accordance with claim 13 further comprising:

a joint joining together the first and second closed angle sections together with the joint being either a weld or a bond.

32. A plate in accordance with claim 14 further comprising:

a joint joining together the first and second closed angle sections together with the joint being either a weld or a bond.

* * * * *